US011378367B2

(12) United States Patent
Pettersson et al.

(10) Patent No.: US 11,378,367 B2
(45) Date of Patent: Jul. 5, 2022

(54) FUSE WITH REVERSIBLE AIRBRAKE

(71) Applicant: BAE SYSTEMS BOFORS AB, Karlskoga (SE)

(72) Inventors: Thomas Pettersson, Karlskoga (SE); Anders Ekberg, Kristinehamn (SE)

(73) Assignee: BAE SYSTEMS BOFORS AB, Kristinehamn (SE)

( * ) Notice: Subject to any disclaimer, the term of this patent is extended or adjusted under 35 U.S.C. 154(b) by 198 days.

(21) Appl. No.: 16/760,469

(22) PCT Filed: Oct. 24, 2018

(86) PCT No.: PCT/SE2018/051085

§ 371 (c)(1),
(2) Date: Apr. 30, 2020

(87) PCT Pub. No.: WO2019/108106

PCT Pub. Date: Jun. 6, 2019

(65) Prior Publication Data

US 2020/0348116 A1 Nov. 5, 2020

(30) Foreign Application Priority Data

Nov. 28, 2017 (SE) ..... 1700294-0

(51) Int. Cl.
*F42B 10/50* (2006.01)
*F42C 19/02* (2006.01)

(52) U.S. Cl.
CPC ..... *F42B 10/50* (2013.01); *F42C 19/02* (2013.01)

(58) Field of Classification Search
CPC ..... F42B 10/14; F42B 10/50; F42B 10/22; F42B 10/54; F42B 10/62; F42C 1/02
See application file for complete search history.

(56) References Cited

U.S. PATENT DOCUMENTS 1,318,926 A * 10/1919 Settle ..... F42B 10/50 102/388
2,923,241 A * 2/1960 House ..... F42B 10/16 244/3.29
5,116,224 A 5/1992 Kelsey
5,762,291 A 6/1998 Hollis et al.
5,826,821 A * 10/1998 Brandon ..... F42B 10/50 244/110 D (Continued)

FOREIGN PATENT DOCUMENTS

DE 2856859 A1 7/1980

OTHER PUBLICATIONS

International Search Report (dated Jan. 2, 2019) for corresponding International App. PCT/SE2018/051085.

*Primary Examiner* — Christopher D Hutchens
(74) *Attorney, Agent, or Firm* — WRB-IP LLP

(57) ABSTRACT

A fuse is provided with a reversible airbrake intended for a projectile, wherein the airbrake is arranged such that errors which occur in the flight path of the projectile can be corrected by performing one or more extensions and retractions of the airbrake. The airbrake includes at least two braking surfaces symmetrically arranged each behind a respective protective device arranged on the casing surface of the fuse, wherein the brake surfaces can be extended and retracted in a rotational direction behind the at least two protective devices via a twist shaft arranged centrally in the fuse.

9 Claims, 2 Drawing Sheets

(56) References Cited

U.S. PATENT DOCUMENTS

| | | | | |
|---|---|---|---|---|
| 7,004,424 | B1 * | 2/2006 | Pacchia | F42B 10/64<br>102/400 |
| 7,611,095 | B1 * | 11/2009 | Alban, III | F42B 10/62<br>244/158.7 |
| 2004/0041059 | A1 * | 3/2004 | Kennedy | F42B 10/14<br>244/3.29 |
| 2005/0116113 | A1 * | 6/2005 | Lawless | F42B 10/14<br>244/201 |
| 2009/0283627 | A1 | 11/2009 | Geswender et al. | |
| 2015/0001335 | A1 * | 1/2015 | Pettersson | F42C 19/02<br>244/3.1 |
| 2016/0252333 | A1 | 9/2016 | Carlqvist et al. | |

* cited by examiner a)

b)

a)

b)

FUSE WITH REVERSIBLE AIRBRAKE

BACKGROUND AND SUMMARY

The present invention concerns a fuse with a reversible airbrake intended for a projectile, for reducing longitudinal spread, for example in artillery firing.

One way of reducing longitudinal spread in firing with artillery is to replace the existing fuse on a projectile or shell with a path-correcting fuse comprising an extendable airbrake. In most known shell designs where a fuse with an extendable airbrake is used, the airbrake extends when the shell has passed the maximum height of the flight path.

US 2009/0283627 concerns an airbrake comprising at least three disc-shaped plates arranged to extend continuously or in stages, fully or partially, laterally from a projectile. One problem however is the effect of centripetal acceleration caused by the rotation of the projectile during its flight. The airbrake extends laterally from the fuse of the projectile; to retract the airbrake again, great force is required to overcome the centripetal acceleration. This therefore requires an extremely powerful drive arrangement for driving the extension and retraction device, and a large battery for the drive arrangement which in turn requires extra storage space in the fuse.

Correction of the flight path of the projectile is based on information about the flight path via satellite navigation. Errors in the flight path which occur after the brake has been extended cannot however be corrected with an airbrake of said type.

It is desirable to produce a fuse with a reversible airbrake, i.e. an airbrake which can be extended and retracted, intended for a projectile. The airbrake is desirably arranged such that errors which occur in the flight path of the shell can be corrected by controlling the braking effect.

The reversible airbrake reduces the path spread for projectiles, for example in artillery firing, as it allows path corrections even in the later parts of the flight path. Satellite navigation of the airbrake also allows selective path correction of different projectiles when firing at one or more targets simultaneously.

An airbrake according to an aspect of the present invention comprises at least two brake surfaces which are evenly distributed around the casing surface of the fuse. Each brake surface is arranged behind its respective wind protection in the form of a protective device. The protective device may be fixedly arranged on the casing surface of the fuse. The protective device reduces the air resistance on the brake surfaces behind it. The protective device may have various forms; in one embodiment, it may comprise brake surfaces which are fixedly arranged and not controllable. In another embodiment, it may comprise brake surfaces which are controllable but are not controlled as protective devices, and are inactive. In other embodiments, they may have different forms depending on the purpose of the projectile.

Behind each fixed brake surface (protective device) is at least one controllable brake surface. There may be one or more rows of controllable brake surfaces. The brake surfaces are reversibly controllable, i.e. they can be extended and retracted in a rotational direction behind said protective device via a twist shaft arranged centrally in the fuse.

In another embodiment, said fuse comprises a reversible airbrake with at least three brake surfaces. The brake surfaces are evenly distributed around the casing surface of the fuse and protected behind respective protective devices, as described above. The controllable brake surfaces are then placed on the same row, which means that there is only one controllable brake surface behind each respective protective device. The number of brake surfaces may be up to ten (three to ten) placed successively in a row, i.e. along the projectile body.

Furthermore, in another embodiment of a fuse with a reversible airbrake, the brake surfaces are arranged successively in pairs behind the respective protective devices which are evenly distributed on and around the casing surface of the fuse. The brake surfaces are then formed by a front brake surface arranged closest to the rear plane of the protective device, and a rear brake surface arranged behind the front brake surface. There are then two rows of brake surfaces which can cooperate to increase or reduce the braking effect on the projectile. The airbrake may also comprise several rows of brake surfaces arranged successively in order to further amplify the braking force. Controlling the braking force means not only increasing the brake effect by enlarging the brake surface area, but also being able to decrease the brake effect by reducing the brake surface area. The brake surfaces may be formed in various ways. They may consist of or comprise several small brake surfaces or few large brake surfaces, and everything in between depending on the design and purpose of the projectile.

The fuse with a reversible airbrake may furthermore comprise one or more brake surfaces at the back.

A front brake ring containing said at least two brake surfaces is arranged closest to the rear plane of the protective device. One or more rear brake rings containing said at least two brake surfaces are then arranged behind the front brake ring.

In one embodiment of the fuse, the airbrake is arranged behind at least two wedge-shaped protective devices which are fixedly arranged on the casing surface of the fuse. The airbrake can be extended and retracted in a rotational direction behind the rear plane of said at least two wedges via a twist shaft arranged centrally in the fuse and coupled to a twist device.

The number of protective devices is not limited; it is at least two but may also be three, four, five or up to ten. These are evenly distributed on and around the casing surface of the fuse.

In one embodiment, the airbrake for example comprises eight brake surfaces arranged in pairs behind four wedges. The paired brake surfaces are formed by a front brake surface arranged closest to the rear plane of the wedge, and a rear brake surface arranged behind the front brake surface. The front brake surface can be extended by twisting the brake surface counterclockwise, and the rear brake surface can be extended by twisting clockwise; in this way, the brake surface has a relatively quite large braking force.

In one embodiment, the eight brake surfaces may be evenly distributed on two twistably arranged brake rings on the rear part of the fuse behind the protective devices. A front brake ring is arranged closest to the rear plane of the protective devices and a rear brake ring is arranged behind the front brake ring. They may be controllable in any way in the radial direction.

In one embodiment, one of the two brake rings comprises a drive ring gear for driving the two brake rings in rotation.

In another embodiment, the brake rings are driven by the twist shaft via the drive ring gears and a two-way gear mechanism. The twist shaft may for example be driven by an electric motor and a battery.

In one embodiment, the brake surfaces are formed with a cross-section which corresponds to the cross-section of the respective protective device, so that in the retracted position the brake surfaces are concealed behind the protective devices when viewed from the front. The brake surfaces may also be formed with a rectangular, circular, fin-shaped or arcuate cross-section. The brake surfaces may be formed in pairs with the same cross-section, but the brake surfaces need not all have the same cross-section.

The brake surfaces may be evenly distributed on twistably arranged brake rings on the rear part of the fuse, but other solutions are also possible.

In one embodiment, the reversible airbrake is driven by a battery and a solenoid or an electric motor.

It is also desirable to provide a method for controlling the longitudinal spread of a projectile. A method according to an aspect of the present invention comprises replacing an existing path-correcting fuse with a fuse which contains a reversible airbrake as described and defined above.

It is also desirable to provide a projectile comprising a fuse with a reversible airbrake as described above.

BRIEF DESCRIPTION OF THE DRAWINGS

The invention is now described as an example with reference to the attached drawings in which.

DETAILED DESCRIPTION

Before the invention is described in detail, it should be understood that this invention is not restricted to specific materials or configurations described herein. The configurations and materials may vary, for example in number, size, material and form of the elements contained in the proposed projectile, and details may be adapted according to the projectile type or types, the weapon system and/or other design properties which arise in the circumstances.

It should also be understood that the terminology applied herein is used merely to describe specific embodiments and is not intended to restrict the scope of the present invention which is limited only by the attached claims.

A reversible airbrake means an airbrake which can be extended and retracted, i.e. the braking effect can be increased or reduced by controlling the size of the brake surface. This allows correction of deviations in the flight path of the projectile, which reduces the longitudinal spread for example on artillery firing. Optimally, the airbrake can be extended and retracted several times during a flight of a projectile, which is possible with the present invention since the braking surfaces move in the rotational direction.

The present invention will now be described in more detail with reference to the attached figures which show exemplary embodiments of the invention.

Figure 1:
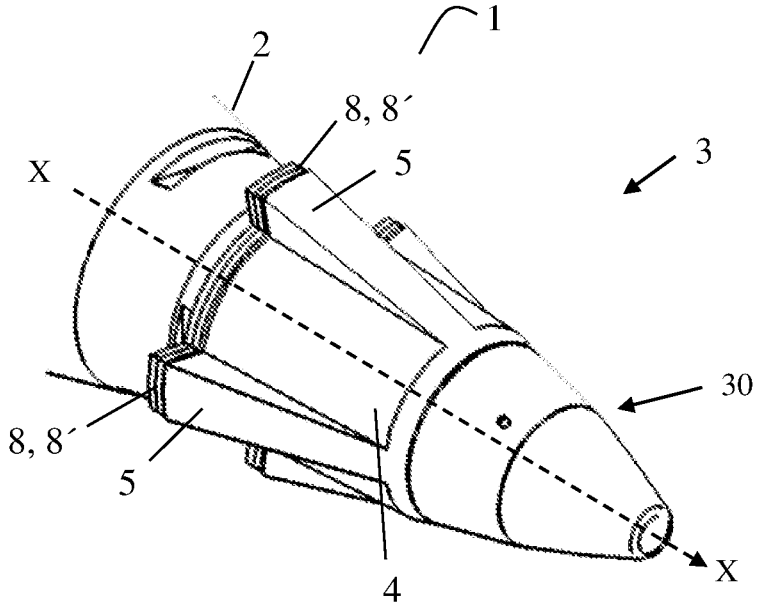
FIG. 1 shows a perspective view of a fuse with reversible brake surfaces in the inactivated, retracted position (a) behind protective devices, and a fuse with brake surfaces in the activated, extended position (b) behind the protective devices.
Figure 1:
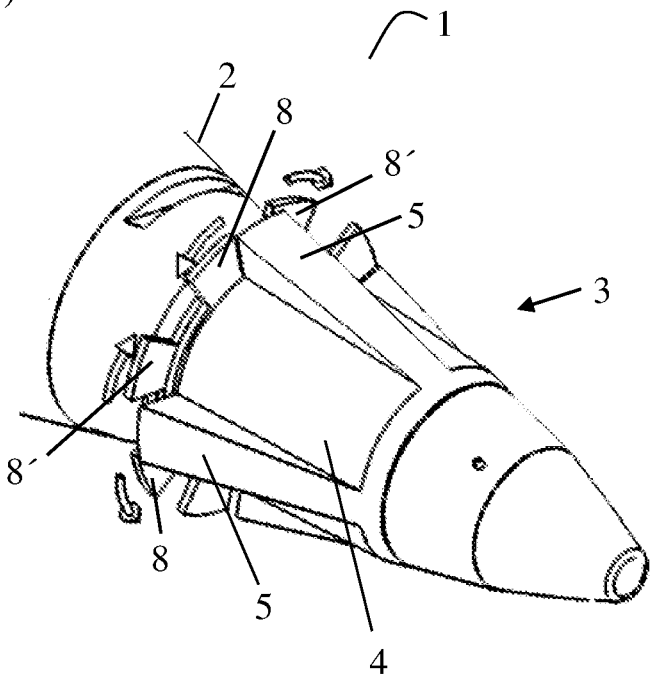

FIG. 1 shows an embodiment of a projectile 2 with a reversible airbrake 1 according to the present invention. The front part 2 of the projectile body is screwed onto the rear part of the fuse 3. The front part of the fuse 3 is protected by a cone/truncated cone 30, the sides of which are called the casing surface 4. The airbrake 1 is in the retracted or non-braking position. The airbrake 1 comprises extendable and retractable brake surfaces 8, 8' which in this embodiment consist of or comprise a front plate 8 and a rear plate 8'. These plates (8, 8') are arranged in twistable fashion on the casing surface 4 of the fuse 3 of the projectile 2. The brake surfaces 8, 8' are arranged behind a protective device 5 which in this embodiment is wedge-shaped. The number of wedges is here four, which are evenly distributed on and around the casing surface 4 of the fuse 3. The protective devices 5 reduce the air resistance of the brake plates 8, 8' of the airbrake 1 during the flight of the projectile 2. In this way, sideways radial movements of the brake surfaces 8, 8' are possible, which means that the brake effect can be controlled/regulated both ways, i.e. an increased or reduced angle of the brake surfaces 8, 8' gives a greater or lesser braking effect. In one embodiment, the respective brake surfaces 8, 8' may be driven both ways, i.e. both clockwise and counterclockwise. In other embodiments, they can only be driven one way. There may be one, two, three or multiple brake surfaces which are arranged behind each other and extended one after another in one direction only, in the manner of a fan. The brake surfaces then become gradually larger or smaller on one side of the respective protective device 5, depending on whether the brake surfaces 8, 8' are angled out or in, and on how many of them are angled out or in. The brake surfaces can be controlled radially sideways in both directions, so the braking effect can be amplified or weakened under control. The movement is stepped or continuous. The extension X-X corresponds to the longitudinal axis of the projectile or the line of symmetry, and the present brake surfaces (8, 8') are extendable and retractable radially sideways behind said protective devices (5) (wind protection), i.e. along the casing surface (4) perpendicularly to the longitudinal axis of the fuse or projectile. The brake surfaces 8, 8' of the airbrake 1 are arranged behind and directly adjacent to the rear plane of the protective devices 5. The protective devices 5 are formed such that their cross-section corresponds to the cross-section of the brake surfaces 8, 8', but other forms may also occur, such as for example fin-shaped, rectangular or arcuate. In this embodiment, the wedges 5 extend axially from the casing surface 4 of the fuse 3, from the rear part of the fuse 3 in the direction towards the nose part of the fuse 3. The airbrake 1 contains eight brake surfaces 8, 8' arranged in pairs behind the rear plane of the four wedges 5. Each of the pairs of brake surfaces 8, 8' is formed by a front brake surface 8 arranged closest to the rear plane of the wedge 5, and a rear brake surface 8' arranged behind the front brake surface 8. The number of brake surfaces fitted behind a protective device is not limited in the invention, since certain embodiments have multiple brake surfaces arranged behind each other. The pairs of brake surfaces 8, 8' are formed such that when retracted, in the inactivated position, they are concealed behind the rear plane of the respective wedge 5 when viewed from the front.

FIG. 1*b* shows the same embodiment of the airbrake as FIG. 1*a* but in the extended braking position. On extension of the brake surfaces 8, 8', the front brake surface 8 of the two paired brake surfaces 8, 8' is twisted counterclockwise around the symmetry line of the projectile 1, so that it appears on the left side of the wedge 5 when viewed from the front. The other brake surface 8' is twisted in the opposite direction, rotationally clockwise, so that it appears on the right side of the wedge 5 when viewed from the front. In other embodiments, they may be controllable in the same way or in opposite ways, or both ways.

Figure 2:
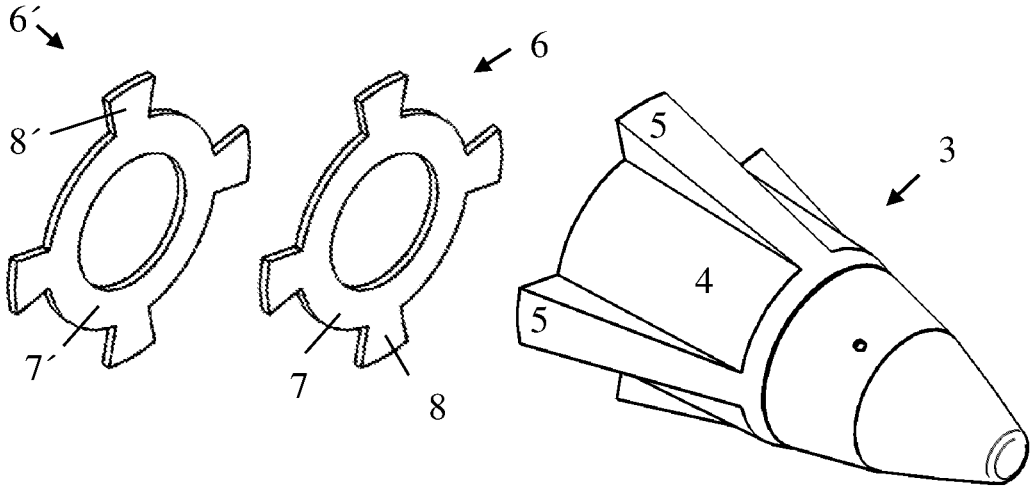
FIG. 2 shows a perspective view of the brake surfaces arranged on brake rings behind a fuse with protective devices (a), and an embodiment with a fixed front brake disc (b) as a protective device.
Figure 2:
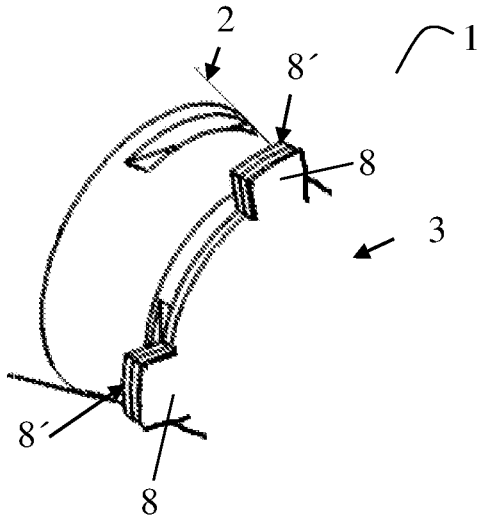

FIG. 2*a* shows an embodiment of the brake discs 6,6'. The airbrake 1 in this embodiment comprises two similar brake discs 6, 6' arranged in twistable fashion, namely a front brake disc 6 and a rear brake disc 6'. In this embodiment, the brake discs consist of or comprise a brake ring 7, 7' on which the brake surfaces 8, 8' are arranged.

A front brake disc 6, 6' according to the present invention comprises or consists here of brake surfaces 8, 8' arranged on a brake ring 7, 7'.

The front brake disc 6 is arranged closest to the rear plane of the wind protection 5, and the rear brake disc 6' is arranged behind the front brake disc 6. In this embodiment, the front brake disc 6 contains four evenly distributed brake surfaces 8, and the rear brake disc 6' comprises four evenly distributed brake surfaces 8'. The brake surfaces 8, 8' in this embodiment are integrated with the brake rings 6, 6' in the form of radially protruding parts on the periphery of the brake rings 6, 6'.

The number of brake surfaces 8 is at least two. The number of brake surfaces 8 may vary, on condition that they are symmetrically balanced around the body 2 of the projectile. The size of the brake surfaces may also vary, since sometimes it is more suitable to have several small brake surfaces 8, 8' which can be extended one after the other, and sometimes fewer large brake surfaces 8, 8', wherein the number or shape of these is not limited in the present invention.

The rotation of the brake discs 6, 6' is driven in one embodiment for example by ring gears. The ring gears may be driven for example by a two-way gear arrangement coupled to a twist shaft which is centrally arranged in the fuse 3 and driven by a battery-powered electric motor. On activation and extension of the airbrake 1, the respective brake discs 6, 6' are twisted simultaneously, via the gear arrangement and twist shaft, respectively counterclockwise and clockwise through a given distance in the rotational direction.

On deactivation and retraction of the airbrake, the respective brake disc 6, 6' is twisted correspondingly in the opposite rotational direction. In another embodiment of the airbrake as a discontinuously variable, on and off brake, the brake discs 6, 6' are twisted instantaneously between two end positions, from fully retracted brake surfaces 8, 8' to fully extended brake surfaces 8, 8', or from fully extended brake surfaces 8, 8' to fully retracted brake surfaces 8, 8'. The position of the brake surfaces 8, 8' is controllable, which means that their position and braking effect can be determined. One or more battery-powered solenoids may be used instead of an electric motor to drive the twist shaft (not shown). The use of solenoids means a cheaper solution than an electric motor, and the projectile would also be lighter with the solenoid solution. Alternatively, the inner parts of the brake discs 6, 6' are formed with drive cogs.

For frictionless rotation of the brake discs 6, 6, a plain bearing may be provided, or one or more ball bearings between the brake discs 6, 6'.

In a further embodiment of the airbrake 1 as a continuously variable brake for selective control of a projectile, the brake discs 6, 6' are instead twisted in stages through short distances for successive correction of the projectile flight path during its travel to the target. Control takes place via satellite navigation. For example, the twist distances are calculated by a programmable control computer, based on collected data from measurement and image sensors arranged in the projectile, for example on speed, direction and position of projectile relative to the target.

FIG. 2*b* shows a further embodiment of said airbrake 1. In this embodiment, the protective device is formed by the first brake surface 8 which is fixedly mounted on the fuse 3, such that the first brake surface 8 is not controllable or is in the inactive position. Behind the first brake surface 8 is at least one controllable brake surface (8') as described above.

An airbrake 1 according to said principle may be formed either as a continuously variable brake or as a discontinuously variable, on and off brake.

For the present embodiment to work, the rotation centre must not be moved from the symmetry axis.

In yet another embodiment (not shown) intended for selective control of several projectiles simultaneously against different targets, the fuse or projectile also comprises a satellite-navigated unit for remote-controlled programming by a programmable control computer.

The protective devices 5 however generate an air resistance, but this is acceptable taking into account the improved controllability provided by a reversible airbrake 1 which can be extended and retracted.

To summarise, the present invention solves the problem of the effect of centripetal acceleration on the airbrake on extension and retraction, because the airbrake is formed with twistably arranged brake surfaces 8, 8'. On extension and retraction of the brake surfaces 8, 8', these are twisted in a rotational direction behind the respective protective device 5, which also allows path corrections in the later part of the flight path towards a target. With real-time control.

The invention claimed is:

1. A fuse with a reversible airbrake, comprising
a casing having a casing surface,
protective devices arranged on the casing surface, and
a reversible airbrake intended for a projectile, wherein the airbrake comprises
at least one brake disc, the at least one brake disc comprising at least two brake surfaces arranged on a brake ring, the at least two brake surfaces being in a form of radially protruding parts on a periphery of the brake ring, the radially protruding parts being evenly distributed around the casing surface and arranged each behind a respective protective device of the protective devices in order to reduce the air resistance of the brake surfaces behind,
wherein the brake surfaces are rotationally movable about a longitudinal axis of the fuse between a retracted position behind the respective protective devices and an extended position and, when retracted to the retracted position, the brake surfaces are concealed behind the respective protective devices when viewed from a front end of the fuse.

2. The fuse with a reversible airbrake according to claim 1, comprising three to ten brake surfaces evenly distributed around the casing surface.

3. The fuse with a reversible airbrake according to claim 1, wherein the brake surfaces are arranged successively in pairs behind the respective protective devices, the respective protective devices defining a rear plane and being evenly distributed on and around the casing surface, wherein the arranged brake surfaces are formed by a front brake surface arranged closest to the rear plane and a rear brake surface arranged behind the front brake surface in a direction away from the frontend.

4. The fuse with a reversible airbrake according to claim 3, comprising one or more rear brake surfaces.

5. The fuse with a reversible airbrake according to claim 1, wherein the brake surfaces are formed with a cross-section which corresponds to the cross-section of the respective protective device, so that in the retracted position, the brake surfaces are concealed behind the protective devices when viewed from the front.

6. The fuse with a reversible airbrake according to claim 1, wherein the brake surfaces are formed with a rectangular, circular, fin-shaped or arcuate cross-section.

7. The fuse with a reversible airbrake according to claim 1, wherein the respective protective devices define a rear plane, and the at least one brake disc includes a front brake ring arranged closest to the rear plane and one or more rear brake rings arranged behind the front brake ring in a direction away from the front end, the brake surfaces are evenly distributed on the front brake ring and the one or more rear brake rings.

8. A method of controlling the longitudinal spread of a projectile comprising an existing path-correcting fuse, the method comprising replacing the existing path-correcting fuse with a fuse comprising a reversible airbrake according to claim 1.

9. A projectile comprising a fuse according to claim 1.

* * * * *